US005797324A

United States Patent [19]

Schoppe et al.

[11] Patent Number: 5,797,324

[45] Date of Patent: Aug. 25, 1998

[54] DRYING DEVICE FOR A SHEET-FED ROTARY PRINTING MACHINE

[75] Inventors: Herbert Schoppe, Neusass; Jurgen Schneider, Frankfurt am Main; Michael Rother, Rodermark; Ulrich Jung, Limburg, all of Germany

[73] Assignee: MAN Roland Druckmaschinen AG, Germany

[21] Appl. No.: 411,485

[22] Filed: Mar. 28, 1995

[30] Foreign Application Priority Data

Mar. 28, 1994 [DE] Germany ..... 9405223 U

[51] Int. Cl.[6] ..... B41F 35/00

[52] U.S. Cl. ..... 101/424.1; 101/416.1

[58] Field of Search ..... 101/424.1, 424.2, 101/487, 488, 416.1

[56] References Cited

U.S. PATENT DOCUMENTS

| | | | |
|---|---|---|---|
| 1,530,932 | 3/1925 | Cochrane | 101/416.1 |
| 2,199,812 | 5/1940 | Barber | 101/416.1 |
| 2,204,802 | 6/1940 | Gessler | 101/416.1 |
| 4,188,883 | 2/1980 | Schone et al. | 101/183 |
| 4,312,137 | 1/1982 | Johne et al. | 101/424.1 |
| 4,526,101 | 7/1985 | Ericsson | 101/416.1 |
| 5,180,096 | 1/1993 | Kondo | 228/180.1 |

FOREIGN PATENT DOCUMENTS

| | | |
|---|---|---|
| 2 239 744 | 2/1974 | Germany . |
| 24 12 493 | 10/1974 | Germany . |
| 26 30 900 A1 | 5/1977 | Germany . |
| 30 01 355 C2 | 1/1987 | Germany . |
| 2 072 821 | 10/1981 | United Kingdom . |

*Primary Examiner*—Edgar S. Burr
*Assistant Examiner*—Anthony H. Nguyen
*Attorney, Agent, or Firm*—Leydig, Voit & Mayer, Ltd.

[57] ABSTRACT

A dryer device for a sheet-fed rotary printing machine including an impression cylinder and an associated forme cylinder, the dryer device including a radiant drying system and a hot-air drying system acting on sheets in the machine; a frame for releasably receiving the radiant drying system and the hot-air drying system, and a guide mechanism for moving the frame and attached drying systems relative to the impression cylinder.

9 Claims, 4 Drawing Sheets

DRYING DEVICE FOR A SHEET-FED ROTARY PRINTING MACHINE

FIELD OF THE INVENTION

The invention relates to a dryer device for a sheet-fed rotary printing machine, the device being suitable particularly for the drying of sheets varnished in the printing machine (in-line varnishing).

BACKGROUND OF THE INVENTION

A multiplicity of dryer devices for solving the problem in general terms are already known. A generic device is known, for example, from DE 2,639,900 A1. According to this, a drying device is arranged between printing units in a special assembly which is formed by a transfer cylinder and a downstream turning drum.

DE 3,001,355 C2 discloses a drying device for a sheet-fed printing machine, which possesses a radiant dryer acting on a sheet-guide cylinder. A shutter mechanism for closing the radiant dryers is actuated via a switching arrangement cooperating with the gripper channel.

A further device of this type is known from German Offenlegungsschrift 2,412,493, in which the radiation capacity of a dryer can be regulated.

A disadvantage of these designs is that, as a result of the fixed arrangement of the drying devices, the necessary introduction of heat cannot be adjusted to the sheet run which varies in the case of different printing materials. The result of this is that reductions in quality (smearing) occur in the printing since the ink to be processed or the particular varnish to be processed has not yet dried sufficiently. Since, in a fixed arrangement of the drying device and in the processing of printing materials having a different basis weight, a sheet run is likewise different, the particular distance between the transported sheets and the drying device also changes. Heat losses occur as a result of the different distances between the sheet and drying device, thus leading to an unnecessary energy consumption. Furthermore, the arrangement of special assemblies for such heating involves an increase in the total length of the printing machine (increased space requirement).

SUMMARY OF THE INVENTION

The object of the invention is to overcome the above-mentioned disadvantages. According to this and other objects, there is provided a drying device for a sheet-fed rotary printing machine with an impression cylinder and an associated forme cylinder. The drying device includes a radiant drying system and a hot-air drying system acting on the sheet. The radiant system and the hot air drying system are releasably arranged on a frame, which is movable relative to the impression cylinder. Sheet-guide elements may also be releasably arranged on the frame. The frame may either be movable in a vertical direction by means of a guide mechanism, or movable in a radial direction relative to the impression cylinder.

An essential advantage of the solution according to the invention is to be seen in that a controlled drying is achieved in dependence on the sheet run of the particular printing material. The dryer device according to the invention is adjusted to a minimum distance from the sheet run of the printing material. The drying time for ink or varnish is thereby reduced and the print quality is further improved. Burns (in the event of an excessive introduction of heat) or radical smearing (in the event of an inadequate drying of ink or varnish) of the printing material are avoided by means of the dryer device being of adjustable height or adjustable radial position relative to the impression cylinder. As a result of the vertical or radial height adjustment of the dryer device, the radiation capacity is matched to the actual heat requirement. The sheet-guide elements are connected to the radiant system and hot-air dryer system arranged on the movable frame and are thus likewise of adjustable height. Sheet guidance in the region of the dryer device is assumed simultaneously as a result of the integration of sheetguide elements. Printing materials tending to come loose or "flutter" at the rear edge of the impression cylinder during sheet transport are guided better on the impression cylinder by the hot-air drying systems set near the impression cylinder.

BRIEF DESCRIPTION OF THE DRAWINGS

The invention will be explained in more detail by means of exemplary embodiments, as shown in the accompanying drawings, wherein.

DESCRIPTION OF THE PREFERRED EMBODIMENTS

While the invention will be described and disclosed in connection with certain preferred embodiments, it is not intended to limit the invention to those specific embodiments. Rather, it is intended to cover all such alternative embodiments and modifications as fall within the spirit and scope of the invention as defined by the appended claims.

All of the references cited herein are hereby expressly incorporated herein, in their entirety, by reference.

Figure 1:
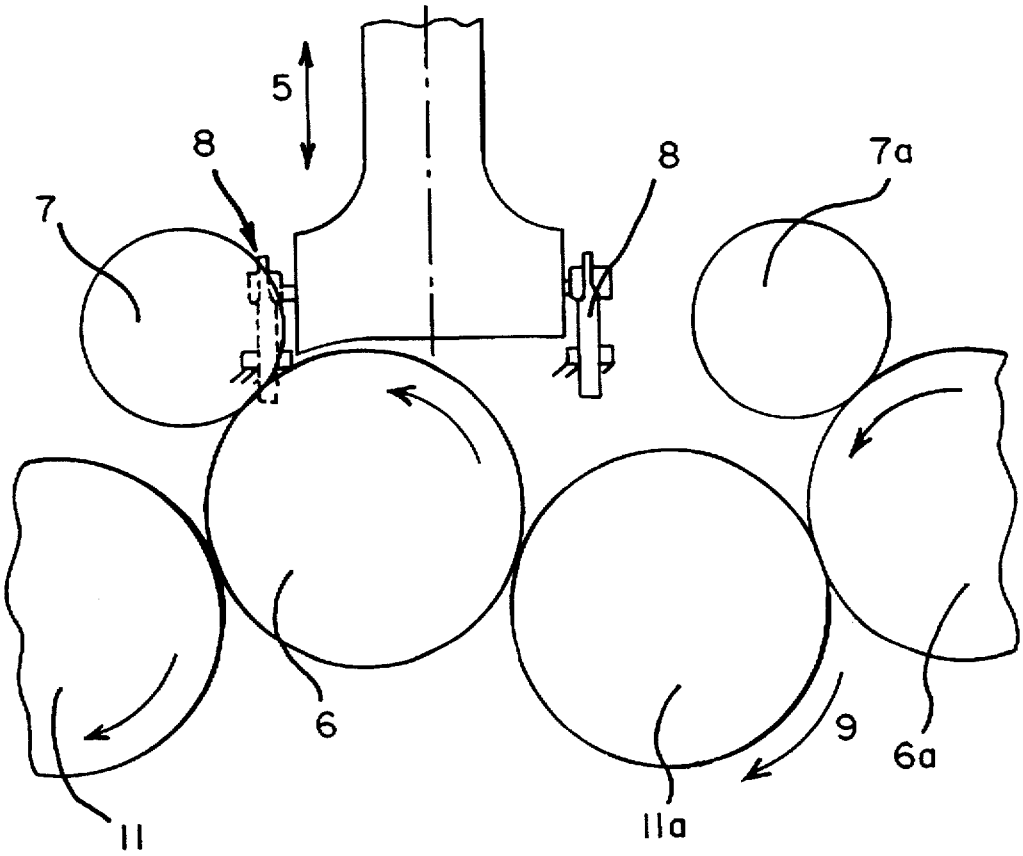
FIG. 1 shows the diagrammatic arrangement of the dryer device in a sheet-fed rotary printing machine.

Turning to the drawings, FIG. 1 shows a print-finishing unit consisting of two varnishing devices which are located downstream of a sheet-fed rotary printing machine for the in-line varnishing of printing materials. While the invention is illustratively shown in connection with an in-line varnishing machine, it is not necessarily so limited, and the invention may be used with other sheet-fed rotary printing machines. The preceding printing units of a sheet-fed rotary printing machine are followed by a first impression cylinder 6*a*, to which a forme cylinder 7*a* is assigned. The first impression cylinder is followed in the sheet-run direction 9 by a sheet-guiding drum 11*a*, downstream of which is located a second impression cylinder 6 with an associated forme cylinder 7. The second impression cylinder 6 is followed by a further drum 11 which, in the present example, is the take-off drum of the delivery. The two forme cylinders 7*a*, 7 are assigned metering systems for the varnish to be processed, which are not to be described any further here. The second impression cylinder 6 is assigned the dryer device which, according to the invention, is moveable relative to the impression cylinder.

Figure 2:
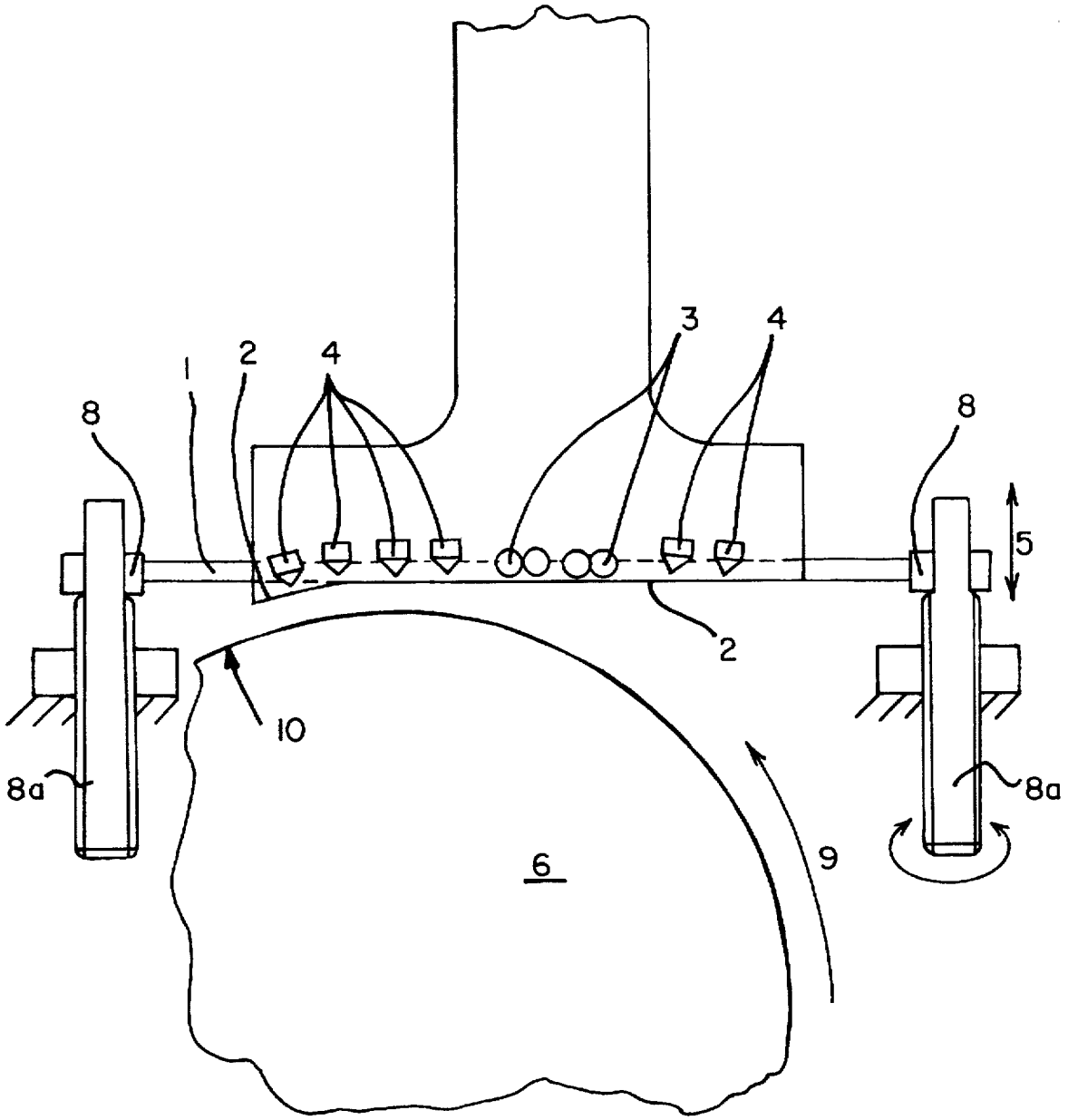
FIG. 2 shows the dryer device with a vertical height adjustment relative to an impression cylinder.

The representative dryer device according to FIG. 2 consists of a frame 1 which is movable in the vertical direction 5 via a guide mechanism 8. The guide mechanism 8 consists of four screw mechanisms which are arranged fixedly on the stand and which each included a respective screw 8*a*. The screws 8*a* preferably are driven synchronously with one another via an appropriate traction mechanism to raise and lower frame 1. In another design, the guide mechanism 8 can also be formed by synchronously operated coupling mechanisms. The dryer device consisting of a radiant system 3 and of a hot-air drying system 4 is arranged on the frame 1. Furthermore, sheet-guide elements 2, for example sheet-guide bars, which may be assigned to the impression cylinder 6, may also be arranged on the frame 1.

The mode of operation of the device is as follows: coming from the preceding printing units, a sheet is supplied via the first impression cylinder 6*a* and, in the region of a printing zone, acquires the print finish in the form of a varnishing. The sheet provided with a varnishing is transferred to the second impression cylinder 6 via the drum 11*a*. The dryer device is assigned to the second impression cylinder 6 upstream of the printing zone 10 in the sheet-run direction 9. A dryer device could alternatively be disposed downstream of the printing zone 10, or a dryer device could be disposed both upstream and downstream of zone 10. The varnished sheet is dried by the radiant system 3 and the hot-air drying system 4, so that subsequently the already varnished sheet may acquire a further varnishing in the printing zone 10 of the second impression cylinder 6 via the associated forme cylinder 7. The sheet is thereafter fed to the delivery in the sheet-run direction 9.

The dryer device of FIG. 2 is illustratively movable in the vertical direction 5 preferably from a control stand. If a sheet having a low basis weight is being varnished, the dryer device is set nearer to the impression cylinder 6 via the frame 1 and the guide mechanism 8. If a sheet having a higher basis weight is being varnished, the frame 1 together with a dryer device is set further form the impression cylinder 6 by a particular amount. According to the invention, the distance between the frame 1, together with the dryer device, and the impression cylinder 6 can be adjusted continuously via the guide mechanism 8. The dryer device adjustable in the vertical direction 5 by means of the frame 1 increases the efficiency of the drying by means of the radiant system 3 and hot-air drying system 4, since the dryer device can be adjusted to the most favorable minimum distance from the printing material. Since, together with the frame 1, the sheet-guide elements 2 are also movable in the vertical direction 5, the sheet run of the printing material on the impression cylinder 6 is improved.

Figure 3:
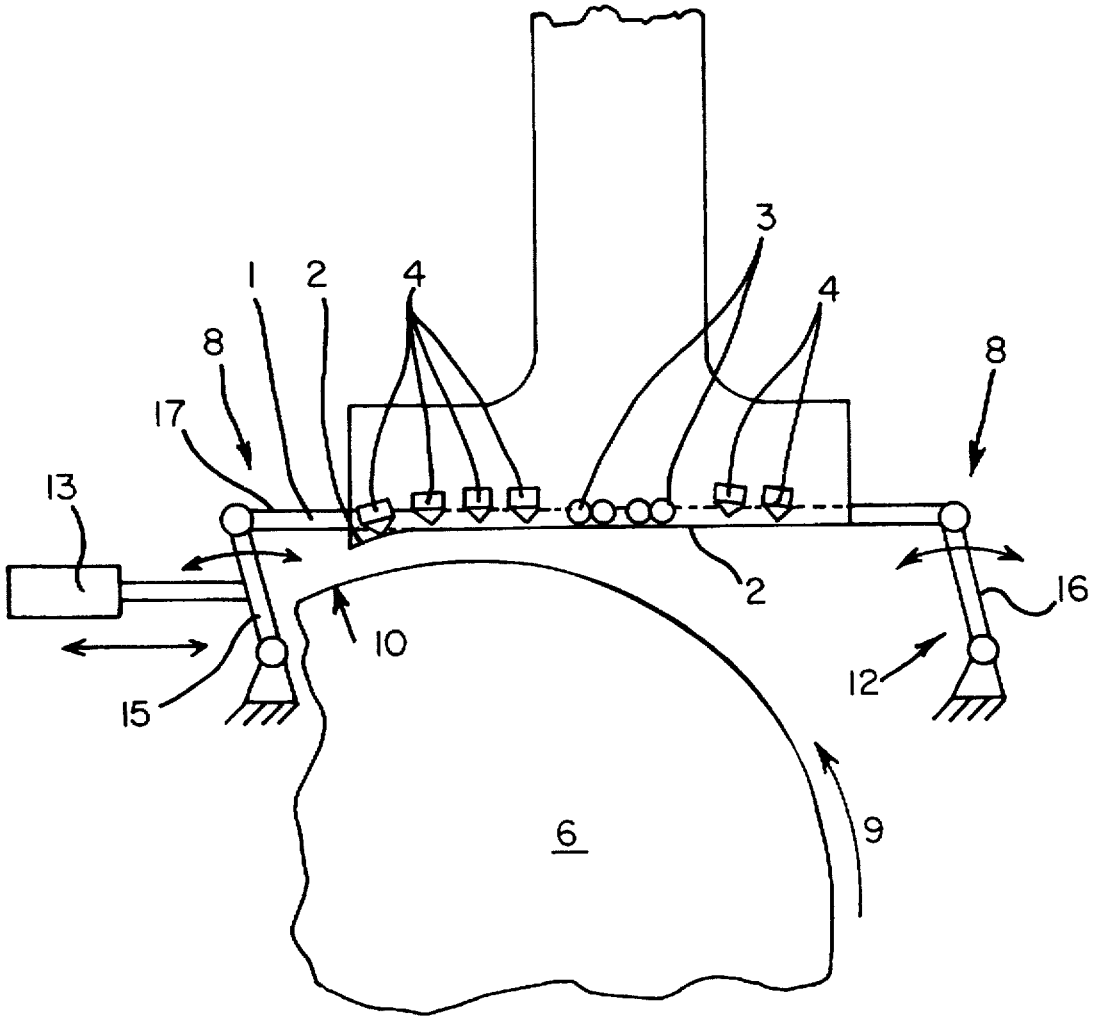
FIG. 3 and 4 show the dryer device with a radial adjustment relative to an impression cylinder.

An alternative embodiment of the dryer device according to the invention is shown in FIG. 3. In this embodiment, the dryer device is movable in a radial direction 12 relative to the impression cylinder 6. In this design, the guide mechanism 8 consists of two three-bar linkages consisting of links 15, 16 and 17 which are mounted fixedly relative to the stand and which are actuated synchronously via one or two working cylinders 13 or another drive. The three-bar linkages can be designed, for example, as a crank-and-rocker linkage or a parallel crank, so that the frame 1 together with the radiant system 3 and hot-air drying system 4 as well as sheet-guide elements 2, is movable in the direction 12 on a coupler curve and each side stand serves as a fixed member.

The mode of operation of this embodiment is similar to the embodiment described previously according to FIG. 2. Both embodiments share the feature of the dryer device being movable relative to an impression cylinder 6 with which it is associated. Here, the dryer device is now movable in the radial direction 12 on a coupler curve and lockable, preferably from the control stand. In the case of sheets with a low basis weight, the dryer device is set nearer to the impression cylinder 6. In the case of sheets with a higher basis weight, the dryer device is set away from the impression cylinder 6 by a particular mount. By the use of a guide mechanism 8 in the manner of one or of two three-bar linkages, the distance between the dryer device and the sheet can likewise be adjusted continuously.

Figure 4:
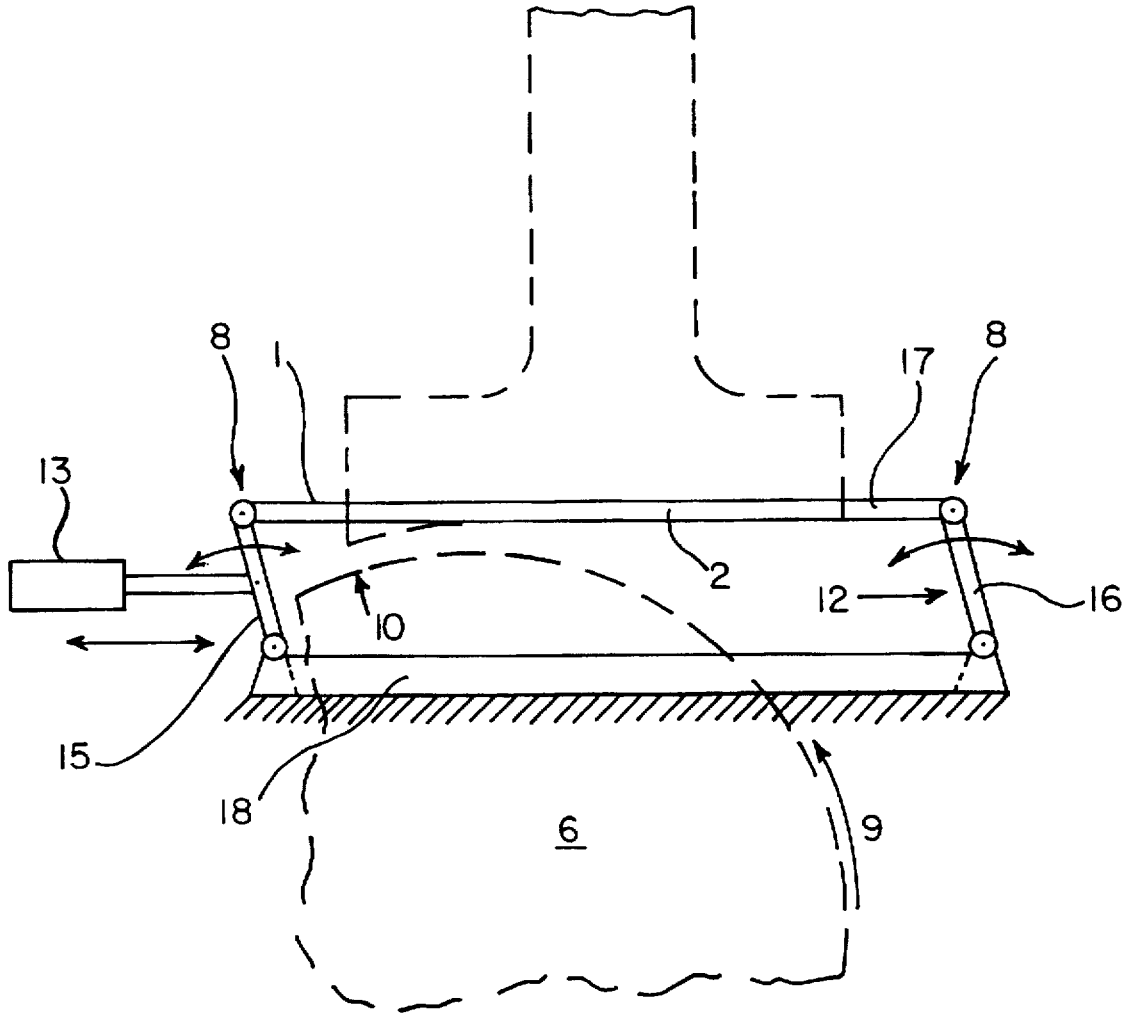

Another alternative embodiment of the dryer device according to the invention is shown in FIG. 4. This embodiment is substantially identical to that shown in FIG. 3, except that it includes four-bar linkages consisting of links 15, 16, 17 and 18 for adjustably positioning the dryer device.

What is claimed is:

1. A sheet-fed rotary printing machine for printing variable weight, flexible sheet material comprising an impression cylinder and an associated form cylinder which together define a printing zone for sheets passing through the printing machine and about the impression cylinder, a dryer device for drying sheets being conveyed through said printing machine and printing zone, said drying device including a radiant drying system and a hot air drying system operable for drying sheets directed about the impression cylinder, a frame upon which said radiant drying system and hot air drying system are removably mounted adjacent the perimeter of the impression cylinder, and a guide mechanism for moving the frame and the drying system supported thereon so as to permit selected positioning of the drying systems relative to the impression cylinder and sheets being transferred thereon for optimum sheet drying.

2. The printing machine of claim 1 in which said guide mechanism is operable for moving said frame vertically relative to the impression cylinder.

3. The printing cylinder of claim 2 in which the guide mechanism includes selectively rotatable screws for moving the frame and the dryers mounted thereon relative to the impression cylinder.

4. The printing machine of claim 1 wherein said guide mechanism is operable for moving said frame in a radial direction relative to the impression cylinder.

5. The printing machine of claim 4 in which the guide mechanism includes movable four bar linkages.

6. The printing machine of claim 5 in which said four bar linkages are mounted for pivotable movement for moving said frame and the dryers mounted thereon radially with respect to the impression cylinder.

7. The printing machine of claim 1 including a varnishing cylinder upstream of said printing zone for providing varnish to said sheets.

8. The printing machine of claim 7 in which said dryers are located at a location between said printing zone and said varnishing cylinder.

9. The printing machine of claim 1 in which said frame has a downstream end with reference to the direction of sheet movement curved for guiding sheets for movement about the impression cylinder.

* * * * *